US007166197B2

(12) United States Patent
Giertz et al.

(10) Patent No.: US 7,166,197 B2
(45) Date of Patent: Jan. 23, 2007

(54) COKE OVEN DOOR WITH WRAPAROUND GAS CHANNEL AND MEMBRANE

(75) Inventors: Hans-Josef Giertz, Ratingen (DE); Klaus Dieter Ruthemann, Gelsenkirchen (DE); Jürgen George, Bochum (DE); Franz Liesewitz, Mülheim a.d.Ruhr (DE); Horst Schröder, Dortmund (DE); Friedrich Wilhelm Cyris, Duisburg (DE)

(73) Assignee: Deutsche Montan Technologie GmbH, Essen (DE)

( * ) Notice: Subject to any disclaimer, the term of this patent is extended or adjusted under 35 U.S.C. 154(b) by 181 days.

(21) Appl. No.: 10/498,677

(22) PCT Filed: Nov. 26, 2002

(86) PCT No.: PCT/EP02/13259

§ 371 (c)(1),
(2), (4) Date: Jun. 10, 2004

(87) PCT Pub. No.: WO03/052027

PCT Pub. Date: Jun. 26, 2003

(65) Prior Publication Data

US 2005/0040025 A1 Feb. 24, 2005

(30) Foreign Application Priority Data

Dec. 14, 2001 (DE) ..... 101 61 659

(51) Int. Cl.
*B01D 3/00* (2006.01)

(52) U.S. Cl. ..... 202/239; 202/242; 202/244; 202/247; 202/248; 202/269; 202/270

(58) Field of Classification Search ..... 202/239, 202/242, 244, 247, 248, 269, 270
See application file for complete search history.

(56) References Cited

U.S. PATENT DOCUMENTS

| | | | | |
|---|---|---|---|---|
| 4,016,045 | A | | 4/1977 | Van Ackeren |
| 4,400,240 | A | * | 8/1983 | Abendroth ..... 202/248 |
| 4,486,271 | A | | 12/1984 | Lorenz |
| RE34,184 | E | | 2/1993 | Baird et al. |
| 5,395,485 | A | | 3/1995 | Nashan et al. |

FOREIGN PATENT DOCUMENTS

| | | |
|---|---|---|
| EP | 0 417 610 | 3/1991 |
| WO | WO 01/30939 | 5/2001 |

* cited by examiner

*Primary Examiner*—Glenn Caldarola
*Assistant Examiner*—Alexis Wachtel
(74) *Attorney, Agent, or Firm*—Andrew Wilford

(57) ABSTRACT

A coke-oven door has an annular periphery normally juxtaposed with an annular door frame. A seal assembly for the door has at least two flexible, relatively displaceable, metallic, and annular membranes each having an annular inner periphery and an annular outer periphery and a U-section channel fixed to the outer periphery of only one of the membranes, open toward the door, and having annular inner and outer edges. The other membrane bears on the one membrane and therethrough on the channel. A mount secures the inner peripheries of the membranes to the periphery of the door. A spring urges the edges of the channel with a spring force against the door frame.

18 Claims, 10 Drawing Sheets

COKE OVEN DOOR WITH WRAPAROUND GAS CHANNEL AND MEMBRANE

CROSS REFERENCE TO RELATED APPLICATIONS

This application is the US national phase of PCT application PCT/EP02/13259, filed 26 Nov. 2002, published 26 Jun. 2003 as WO 03/052027, and claiming the priority of German patent application 10161659.7 itself filed 14 Dec. 2001.

FIELD OF THE INVENTION

The invention relates to a coke-oven door with a peripheral gas channel and membrane.

BACKGROUND OF THE INVENTION

Such a door is known from WO 01/309390 (Canadian equivalent 2,421,289). The gas channel on the coke-oven door forms a seal system for preventing the entry and exit of vapors from the coke-oven chamber, so that combustion gases cannot leak from the coke-over chamber and air cannot get into the coke-oven chamber.

It is important that the door seal or door edge form a tight seal around the entire periphery of the gas channel.

It is known that the change in temperature vertically along the door causes the door to bend. There are many suggestions of how to make the seal of the coke-oven door compensate for such deformation. These solutions all have the disadvantage that the spring-loaded seal travel is insufficient to compensate for all deformations.

German 4,103,504 (US equivalent U.S. Pat. No. 5,395,485) describes a coke-oven door where a membrane is pressed by springs against a frame of the coking chamber. The problem with this system is that the membrane must be thick enough that it can withstand the spring forces, that is the membrane must be sufficiently mechanically rigid. The membrane should not be damaged or destroyed by standard cleaning procedures. On the other hand, the membrane must be relatively bendable. These two conflicting requirements are never both met, so that the deformability of the membrane by the springs is insufficient and sealing is unsatisfactory.

OBJECT OF THE INVENTION

It is an object of the invention to provide a coke-oven door with a peripheral gas channel whose seal can be moved sufficiently by its springs that the gas channel can conform to any deformations and always provide a good seal. In addition the seal system should be compact enough that it is retrofittable on existing coke-oven doors.

SUMMARY OF THE INVENTION

This object is achieved in that the gas channel is mounted on a membrane having at least two layers, and/or the membrane is comprised of at least two flexible and relatively slidable layers.

The invention is based on two general ideas. On the one hand the gas channel should be spring-biased with a force that is as uniform as possible over its length while still having the greatest possible range of movement or travel; on the other hand the spring force should be so effective on the gas channel that the biasing force applied to the outer door edge is greater or at least equal to the pressure applied at the inner door edge. The seal between the gas channel and the coke-oven door is ensured by a membrane that must be able to deflect considerably while still being quite strong in order to compensate for all possible deformations. The gas channel has therefore to be flexible so that at every point the outer door-seal edge bears with the same pressure.

As a result of the flexibility of the membrane it is possible to make the structure very compact while still allowing it to deflect considerably. These factors make it possible using existing mounting hardware to retrofit coke-oven doors where limited space is available.

The embodiment of the membrane in combination with the spring and the resulting large spring travel is in and of itself an invention, that is this embodiment can be used in standard systems regardless of the type of gas channel.

If for example conditions preclude the provision of the gas channel, the seal system of the invention can be used to replace any preexisting seal system. The membrane with its considerable flexibility ensures better sealing even with conventional seal systems.

The seal system according to the invention makes it possible to compensate for any possible deformations of the chamber frame and also of the coke-oven door so that at any time a complete seal is guaranteed. When using the gas channel the seal system also has the advantages described in WO 01/30939, that is gas-pressure equalization between the gas channel and the coke-oven chamber and so that as a result the crude-gas pressure on the outer seal edge is more easily controlled.

According to the invention the membrane is formed of at least two sheets. This embodiment has the advantage that the elastic deformability of the membrane is improved with respect to a membrane having a single sheet of uniform thickness. As a result of the elastic properties of the membrane, the membrane returns to the starting position under spring force when the pressure on it is lessened.

The membrane according to the invention can be sandwiched together of several different materials. The membrane sheet closest to the gas channel is made corrosion resistant while the central membrane (e.g. spring steel) serves as spring and the upper one contributes to the spring function.

According to a further embodiment of the invention, the membrane is formed of two sheets. The individual sheets are more elastic than a single sheet of a thickness equal to the combined thickness of both sheets, and the sheets can slide on each other on deformation.

The membrane can also be made as a laminate. In the simplest case the two sheets are joined together. This can be done for example by webs or other materials, e.g. plastics or glues. They can also be joined by the tar recovered in the coke plant.

The individual sheets of the membrane can have different thicknesses. In this manner the bending characteristics of the membrane can be varied over a wide range and optimally matched to requirements.

The individual sheets of the membrane are no more than one centimeter thick. With this embodiment the membrane can be made of quite a few individual sheets that can shift relative to one another. In this manner outer faces of the individual sheets slide on one another. The membrane is thus more flexible and can deform elastically more. As a result more spring travel is possible. This embodiment has the advantage that damage to one of the individual sheets is automatically sealed by the sticky condensate (tar).

It is also possible that the sheets that seal the door opening are heat-and corrosion resistant and the other sheets are constituted so that they impart sufficient bendability to the membrane.

According to a further embodiment of the invention at least one of the sheets is a spring. As a result, the membrane itself contributes to the spring action.

The sheets forming the membrane can be molded. Thus any possible type of spring or membrane sheet known in the art can be used.

It is of course also possible to combine individual sheets with the above-described characteristics.

The membrane according to the invention can be made of any type of springs known in the art. As a result of its considerable bendability it can accommodate any spring travel.

It is also possible to make the membrane as the spring. To this end one or more of the sheets of the membrane is made as a spring.

According to an embodiment the spring is formed as a stack of leaf springs that are jointly fixed to the door plate above the membrane and that press on the gas channel. To this end in order for the seal edges to compensate better for deformations, the leaf springs are formed as segments.

Another possibility is to provide the door plate with mounting elements for carrying a push rod that presses on the gas passage. The push rod can be biased for example with spring washers, coil springs, or even by a hydraulic or pneumatic unit against the gas channel.

A further possibility of biasing the gas channel is to mount a leaf spring on the door plate. In this embodiment the leaf spring can itself be a relatively stiff element with limited elasticity and the actual spring travel is created by the spring mount.

The spring mount can be done e.g by spring washers that bear on a screw. A further embodiment is mounting a spring on a spring bar. It is also possible to make a spring such that it assumes the spring function of the spring washers or spring bar. This embodiment has the advantage that a single spring part can be used to take care of two different spring functions.

Such an arrangement ensures that the gas channel is mounted in a spring system with a relatively large travel. The spring travel is created by the stroke of the spring and the stroke that is imparted to the spring by its mount.

The membrane must be made such that it can follow the full spring travel. On the other hand the membrane must be sufficiently springy that it returns to its starting position. This of course applies to all the spring components of the spring system.

According to the invention it is possible to provide a rigid double seal (gas channel) with a large spring travel on the door frame, the biasing force being the same over its entire length.

With the above-described spring system it is possible to create any desired biasing force with the desired distribution and spring characteristic, that is the inner and outer edges of the gas channel can be biased with different or the same biasing forces. Thus for example various leaf springs can be used together so as to produce a spring effect that increases with increasing deflection. This can be done either by changing the shape or length of the leaf springs or by providing stops spaced at appropriate distances from the spring.

The same possibilities also exist with other spring systems. When using the system with pusher rods, attention must be paid that the biasing force is spread out by an appropriate pressure-distributing bar. Such a pressure-distributing bar must be so flexible that the gas channel can fit to the nonplanarities of the chamber frame.

The springs can also be prestressed to different extents to achieve the desired biasing.

The springs can also be made as a laminate. To this end all the known systems can be used. Since the style of lamination of the membranes in springs affects flexibility, lamination can be used both for the springs as well as for the membrane.

Such layering can be such that passages are created between the individual layers of the spring or of the membrane. The passages can be set up to conduct an appropriate heating or cooling medium. It is also possible to fill the passages with insulation.

The gas chamber must be set up such that it can compensate for irregularities and deformations of the chamber frame. On the other hand the gas chamber must have a large enough cross section that crude gas can be carried away without any pressure buildup. In any case the gas channel has an inner and outer seal edge. The gas channel must be as flexible as possible at these edges. It is therefore possible for example to make the edges of the walls of the gas channel at the sealing edges somewhat thinner or to cut them away or bend them back and thus increase the bendability in this region.

It is also possible to mount a door-sealing lip on the inner or outer wall of the gas channel. The gas channel can also be formed of appropriately formed elements of the membrane or of the spring (leaf springs).

A particular problem is sealing coke-oven doors at the corners. The invention suggests that the membranes at the corners are made of one piece, that is the individual layers of the membrane are made of one piece for the upper and lower regions such that they form a U. The membrane that seals the long sides of the coke-oven door is fitted to this U-shape. With this system a long-lived gas seal is created since the seams lie outside the strongly loaded corner regions.

The individual parts of the membrane can be connected together by welding. As a result of the construction of the membrane as individual layers, the membrane can be connected together such that the seams of the individual layers are offset to one another. As a result of this overlapping of the individual layers of the membrane in this region there is excellent gas sealing. Since in these connection regions the membranes have the same thickness, the individual membrane sheets must be butted. This butting can be done in different ways. In the simplest case the individual membrane layers are cut square and pushed together edgewise. It is also possible to butt the membrane layers on diagonals. The edges of the individual membrane sheets can also be beveled so that they meet at a sharp edge. The diagonal orientation of the butting edges increases the length of the seal surfaces while the angling (sharpening) of the membrane layers increases the seal surface.

With the membrane according to the invention with its layered construction it is possible to mount the membrane in corner regions. In this embodiment the individual membrane layers are of reduced thickness where they overlap so that the two overlapping layers together have the thickness of a single layer. This can be done for example by beveling (sharpening) or by appropriately milling away (forming a step).

These connections are stabilized by the tar present in the crude gas that gets into the cracks or interstices. As a further embodiment, tar can also be used as a glue or adhesive in the construction of the membrane to unite the individual membrane layers.

In the embodiment of a membrane having layers less than one millimeter thick, the individual membrane layers can be overlapped without special procedures in the joint regions. It is sufficient to offset the membrane sheets in the joint regions.

Since the profile of the gas channel engages the chamber frame and is not shaped by the spring, in these region there are no stresses or only minor ones. The gas channel can have mitered corners. Since in this region the weld seams are only subject to modest forces another type of joint can be used. It is also possible to insert one part of the gas channel into another at the corner. Such an inserted joint is shown in the drawing. The exact type of insert connection can be provided at any desired region of the gas channel.

The seal system according to the invention with membrane, gas channel, and spring is exceptionally good for sealing leaky coke-oven doors. It is possible to retrofit all coke-oven doors on the market. The membrane with spring according to the invention can also be used to retrofit all the known seal systems.

The parts described above can according to the invention be made in different sizes and shapes, of different materials, and according to different principles so that the scope of the invention is not limited.

BRIEF DESCRIPTION OF THE DRAWING

Further specifics, features, and advantages of the invention are seen from the following description and the corresponding drawing in which by way of example several embodiments of the invention are shown. Therein.

SPECIFIC DESCRIPTION

Figure 1:
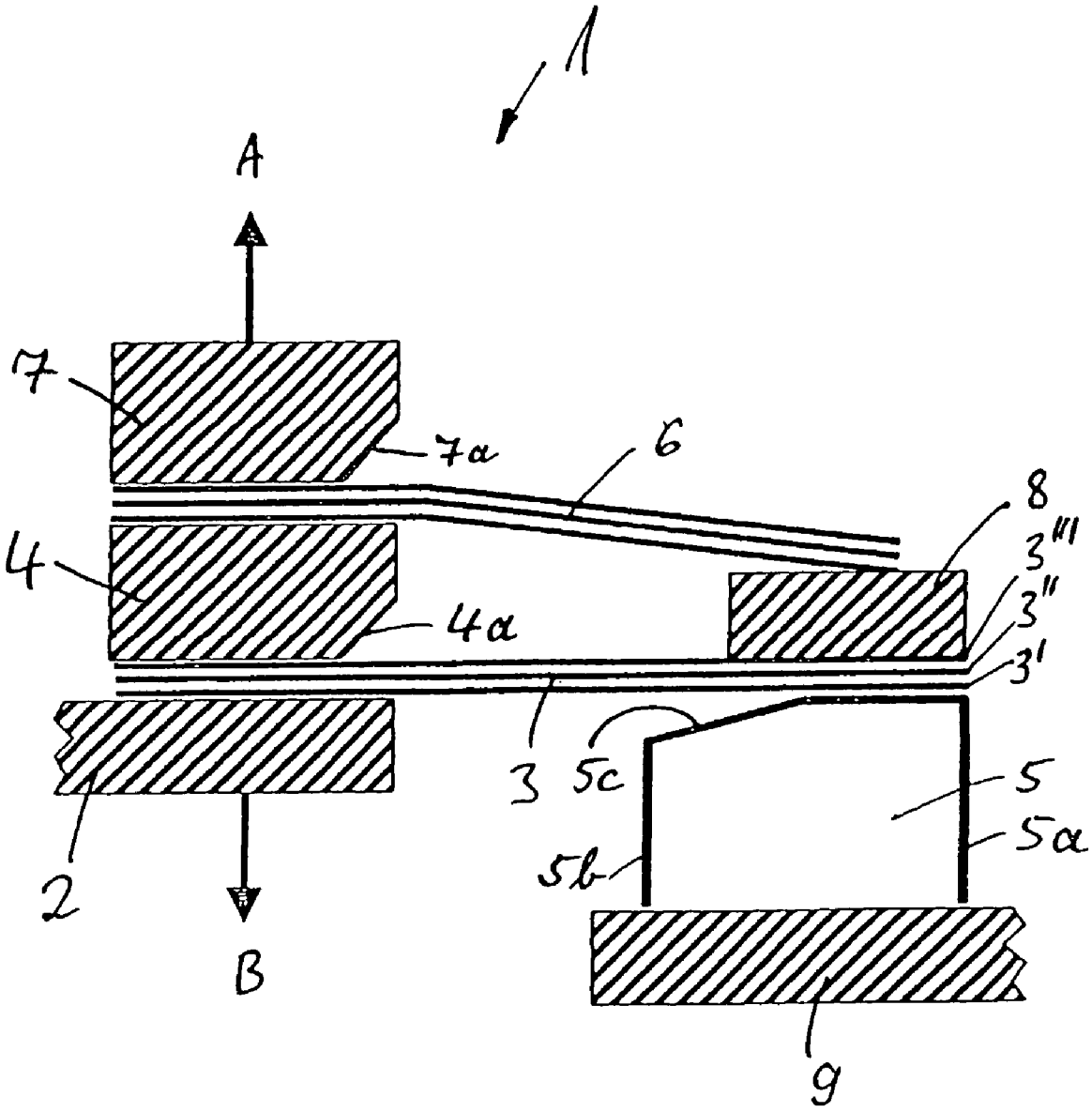
FIG. 1 is a partial section through a coke-oven door with gas channel, membrane, and leaf spring.

FIG. 1 is a partial view of a coke-oven door 1 at its peripheral gas channel 5. A membrane 3 is fixed by a mounting element 4 on a door plate 2 of the coke-oven door 1. The mounting element 4 has an edge bevel 4*a*. The membrane 3 is comprised of three vertically spaced sheets 3', 3", and 3'". The gas channel 5 is defined between an outer edge 5*a* and an inner edge 5*b* at an outer periphery of the membrane 3. The gas channel 5 has on the inner door-seal edge 5*b* an edge bevel 5*c*. Leaf springs 6 that are supported on a mounting element 7 are carried on the mounting element 4. The mounting element 7 also has an edge bevel 7*a*. The leaf springs 6 press against a bar 8 that is secured to the edge of the membrane 3 at the gas channel 5. The gas channel is pressed by the leaf springs 6 against the chamber frame 9 of an unillustrated coke-oven chamber. Thus the gas channel 5 seals against the chamber frame 9. Movements caused by deformations of the chamber frame 9 and/or of the coke-oven door 1 are compensated for by the leaf springs 6 in that the gas channel 5 is always pressed sealingly against the chamber frame 9. The flexible membrane 3 offers very little resistance to the leaf springs 6. The bevels 4*a* and 5*c* of the mounting element 4 and gas channel 5 allow the membrane 3 to follow the movements created by the leaf springs 6. The range of movement of the coke-oven door 1 is shown by arrows A and B. The bevel 7*a* of the mounting element 7 creates a long lever arm and thus a larger range of movement of the leaf springs 6.

Figure 2:
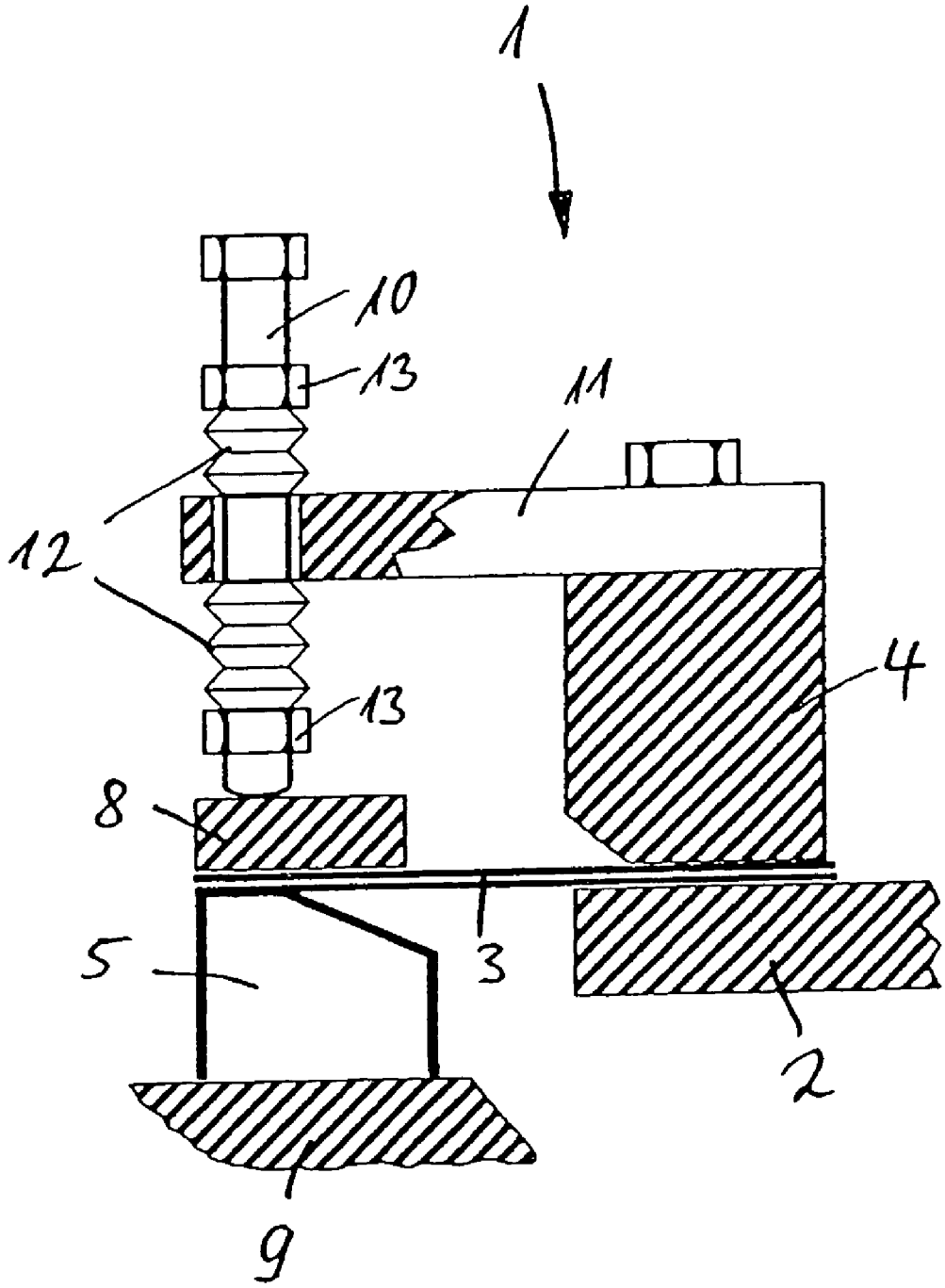
FIG. 2 is an embodiment with a pusher rod and spring washers.

FIG. 2 shows another embodiment of the seal system according to the invention. A holder 11 for a pusher rod 10 is mounted on the door plate 2 with the membrane 3 and the mounting element 4. The pusher rod 10 carries stacks of spring washers 12 that urge the pusher rod 10 toward the bar 8 and toward the gas channel 6 as a pressure-distributing beam and thereby press the gas channel 5 against the chamber frame 9. The spring washers 12 are prestressed by lock nuts 13.

Figure 3:
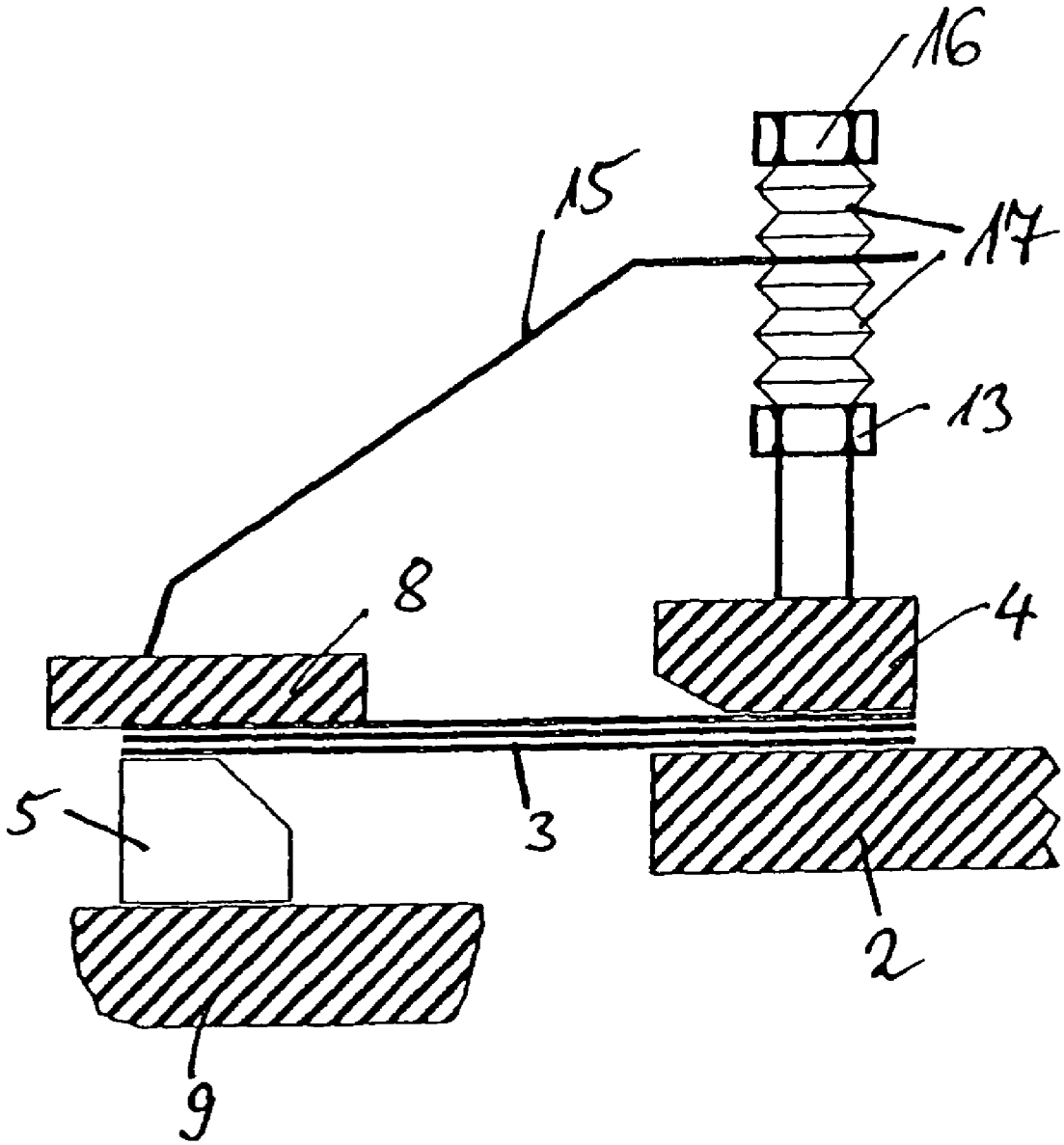
FIG. 3 is an embodiment with a spring-mounted biasing unit.

FIG. 3 shows how the gas channel 5 is pressed by a leaf spring 15 against the chamber frame 9. The leaf spring 15 is supported by stacks of spring washers 17 on a screw 16 that is in turn mounted on the mounting element 4. With this spring mount there is a considerable range of movement for the leaf spring 15.

Figure 4:
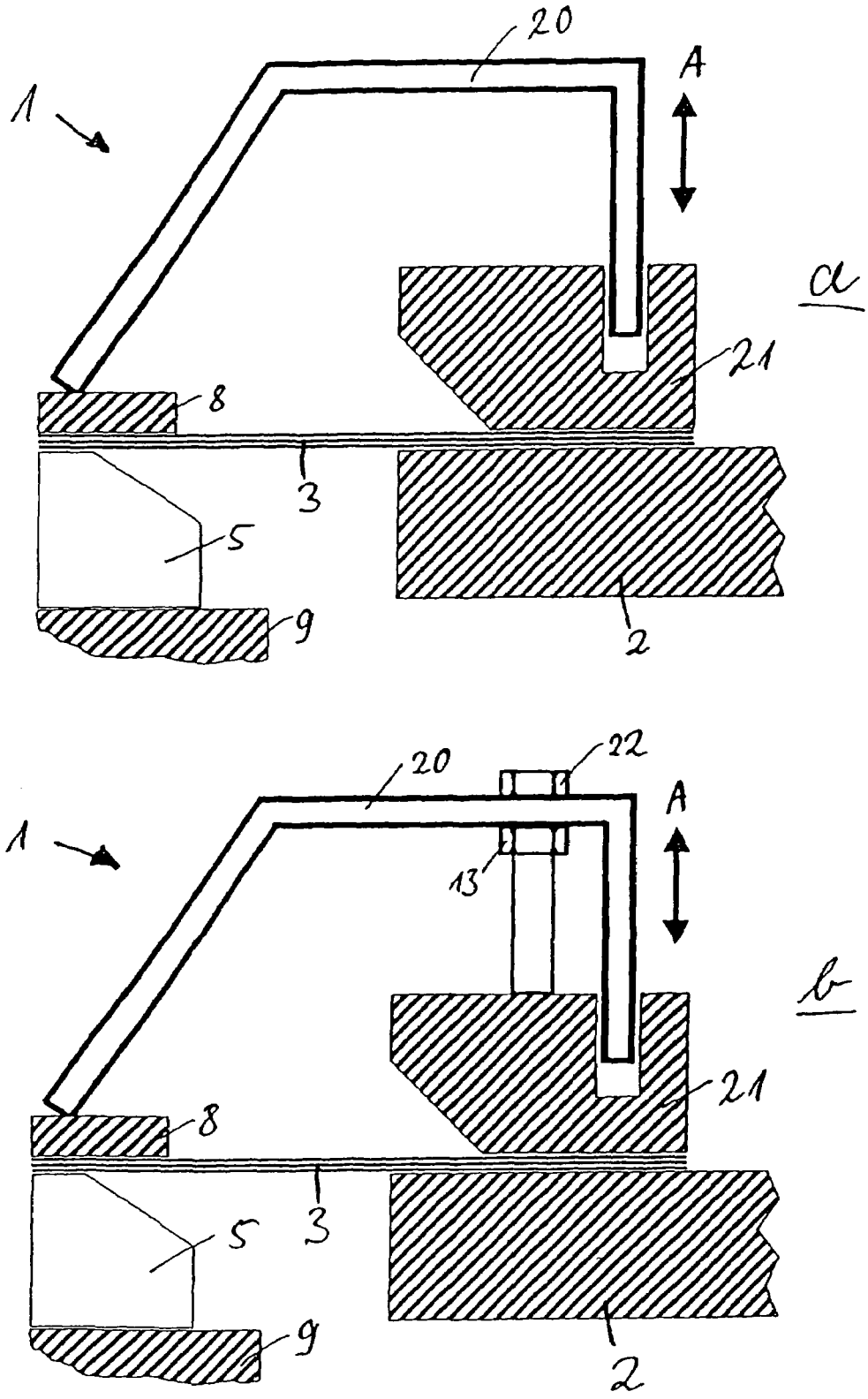
FIGS. 4*a* and 4*b* are an embodiment with a biasing unit formed by a structural element.

FIG. 4*a* shows a further embodiment of the seal system for a coke-oven door 1 having a spring that is formed as a biasing element 20. The spring biasing element 20 pushes via the bar 8 and the membrane 3 on the gas channel 5 that is thus pressed against the chamber frame 9. The depth of engagement of the spring-biasing part 20 in a holder element 21 as shown by double-headed arrow A allows the spring travel and characteristics to be varied.

FIG. 4*b* shows the same embodiment of the spring. A screw 22 allows the spring part 20 to be prestressed.

Figure 5:
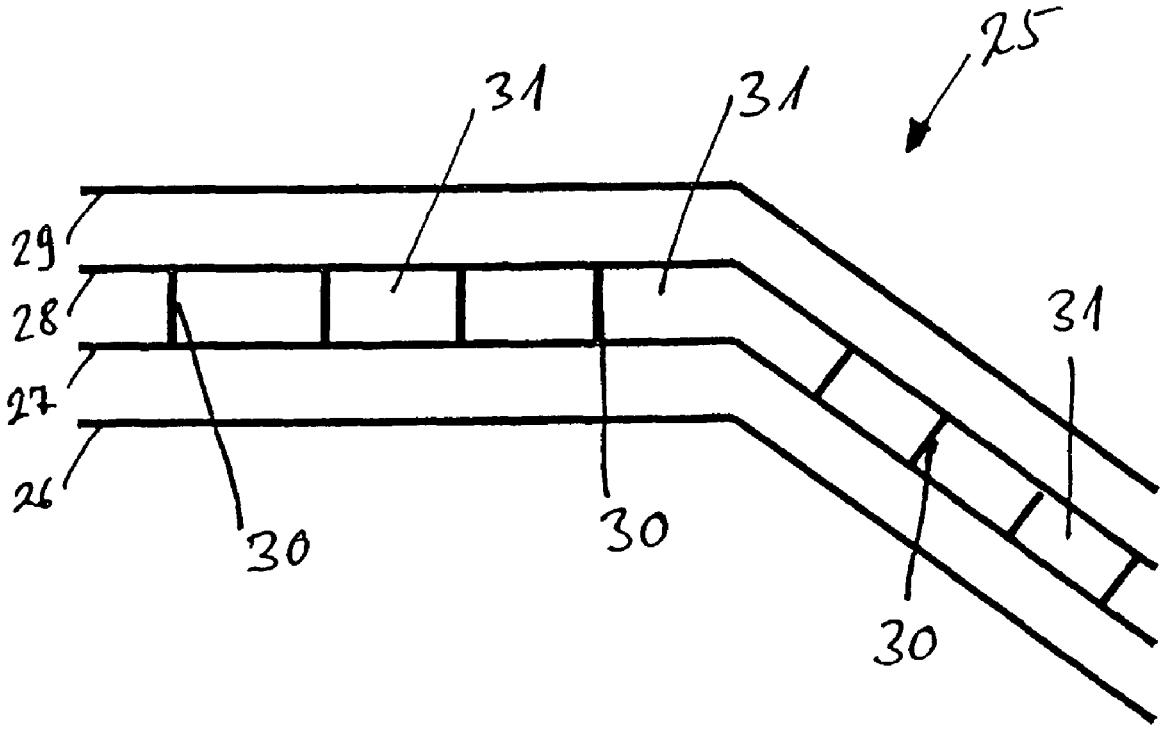
FIG. 5 is an embodiment of a multilayer membrane.

FIG. 5 shows a membrane 25 formed of multiple layers. The membrane 25 is comprised of membrane sheets 26, 27, 28, and 29. The membrane sheets 27 and 28 are connected together by webs 30. The webs 30 form passages 31 between the membrane sheets 27 and 28. The passages 31 can hold a fluid so that the passages 31 serve as cooling or heating passages. It is also possible that the passages 31 and/or the spaces between the membrane sheets 26 and 27 or 28 and 29 are filled with insulation so that the membrane 25 or at least part of the membrane 25 functions as an insulating layer.

Figure 6:
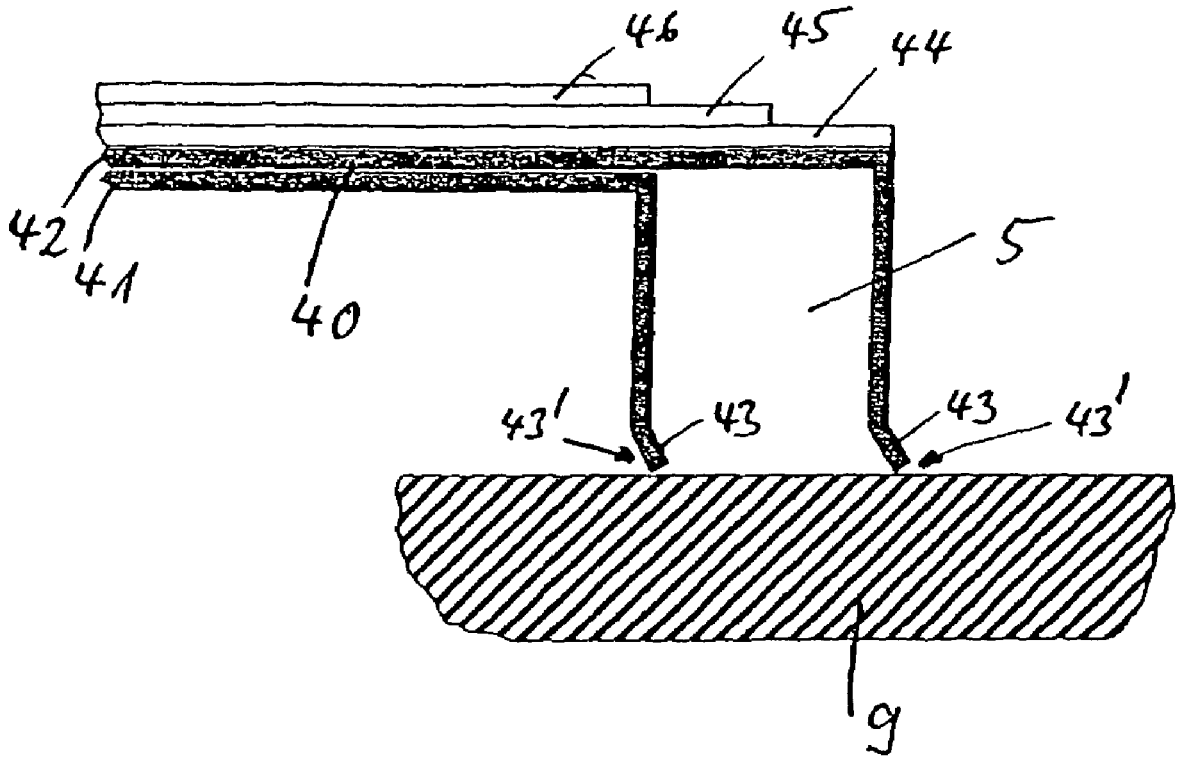
FIG. 6 is an embodiment wherein the biasing unit, membrane, and gas passage are all one assembly.

FIG. 6 shows a membrane 40 with membrane sheets 41 and 42. The membrane sheets 41 and 42 are bent at right angles at their free ends and are clamped together at their other ends so that the gas channel 5 is formed between two of the right-angle end portions. At lower outer ends of the right-angle end portions the membrane sheets 41 and 42 have bent-back edges 43. These bent edges 43 form seal edges 43' that seal the gas channel 5 relative to the chamber frame 9. Leaf springs 44, 45, and 46 press against the membrane 40. The leaf springs 44, 45, and 46 are of different lengths. In this manner the spring force increases with increasing deflection.

Figure 7:
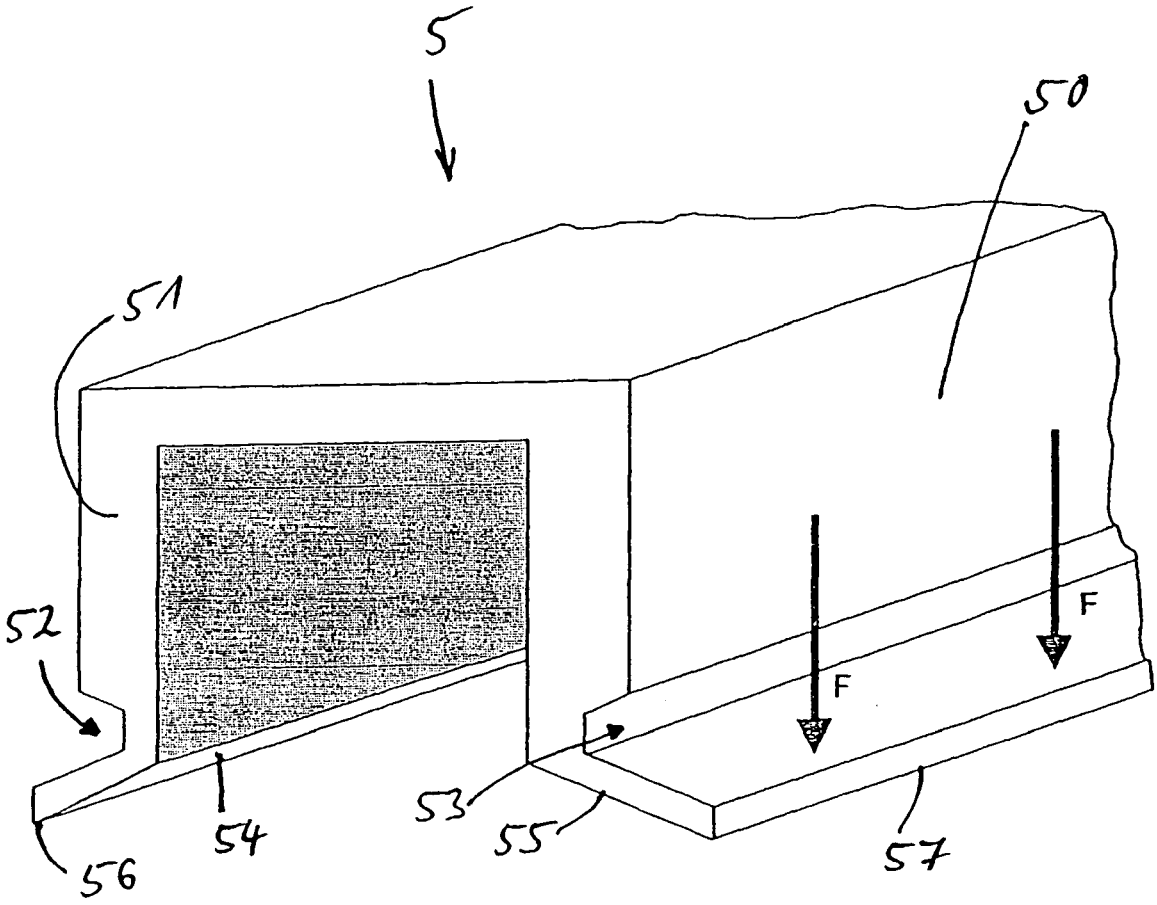
FIG. 7 is an embodiment of the gas channel with a flexible door-sealing edge.

FIG. 7 shows the gas channel 5 with an outer door-seal edge 50 and an inner door-seal edge 51. The inner door-seal edge 51 has at its lower end a groove 52. Below the groove 52 the inner door-seal edge 51 is formed with a bevel 54 so that it forms a door-sealing lip 56. The outer door-sealing edge 50 similarly has on its lower edge a groove 53 and a bevel 55. The bevel 55 extends over the entire length of the door-seal edge 50. In this manner it is possible to press with a spring force F directly against the door-seal lip 57 and thus get flexible accommodation to the chamber frame 9.

Figure 8:
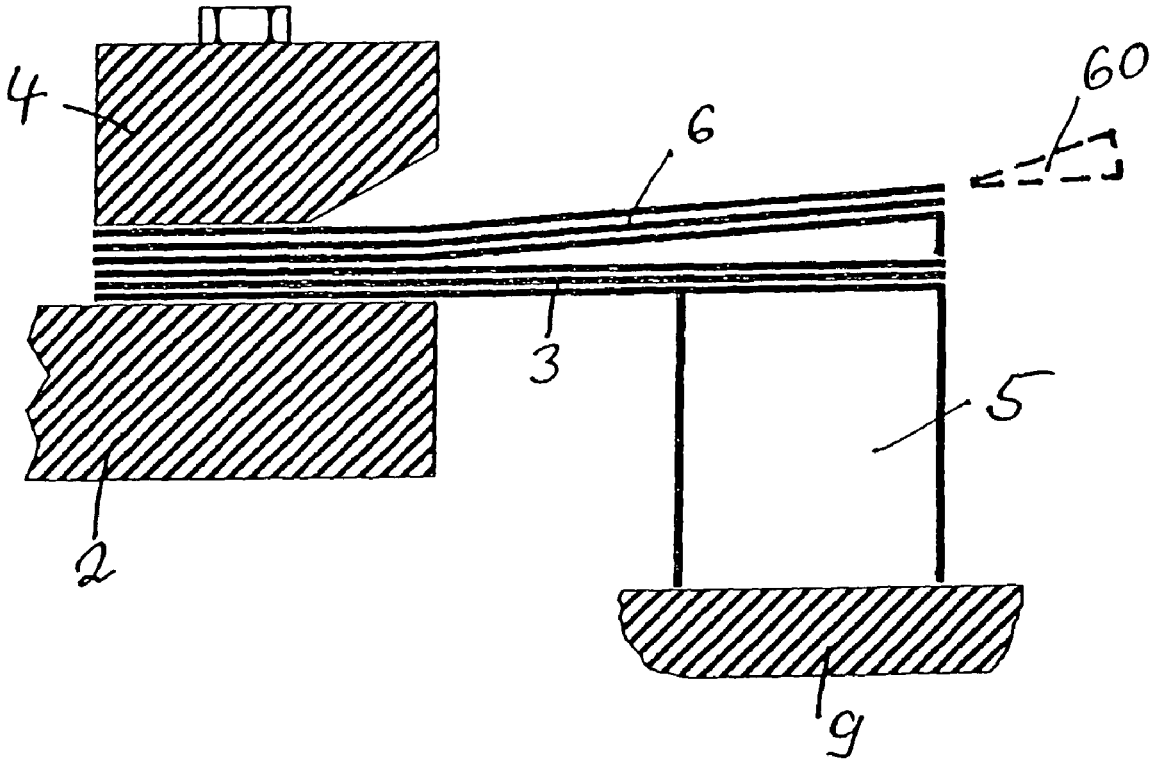
FIG. 8 is the embodiment of FIG. 1 wherein the biasing force is applied in the region of the outer door-seal edge.

FIG. 8 shows how the membrane 3 and the leaf spring 6 are secured with the mounting element 4 to the door plate 2. The lowermost leaf spring of the leaf spring assembly 6 is bent over on its free end and thus forms point or line contact between the membrane 3 and the outer door-seal edge of the gas channel 5. The point or line contact of the leaf spring 6 can be increased by pushing a wedge 60 between the individual leaf springs of the leaf-spring assembly 6.

Figure 9:
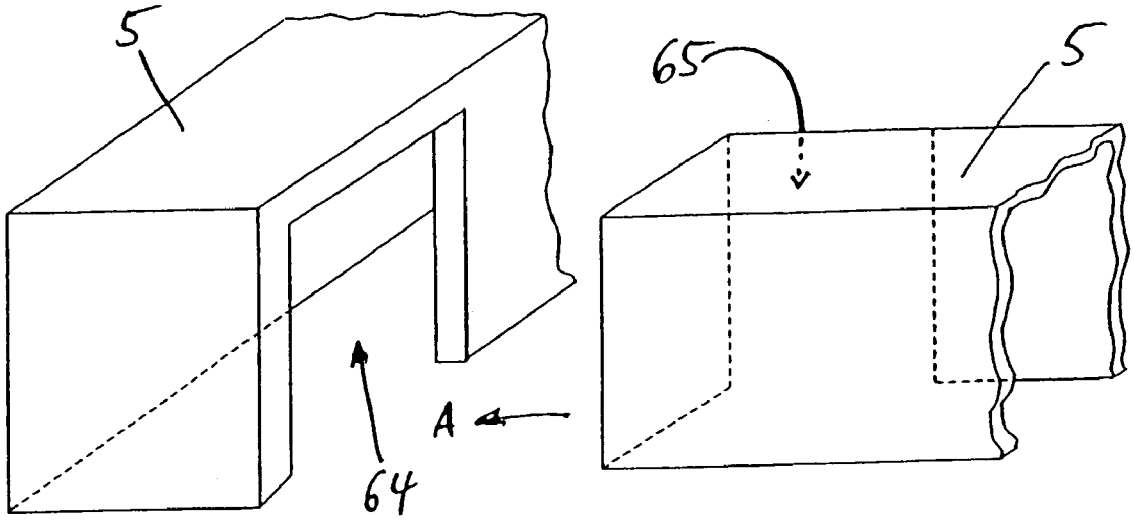
FIG. 9 is an embodiment of the corner of the gas channel with plug-in interfit.

FIG. 9 shows a corner region of the gas channel S. The gas channel 5 is formed by connection in the direction of arrow A at a corner region. To this end the right-hand part of the gas channel is inserted into an opening 64 in the left-hand part. An opening 65 in the right-hand part of the gas channel permits unhindered gas flow at the corner region of the gas channel 5. The fit is tight enough that further connecting elements for the two parts of the gas channel 5 are not needed since any leaks are plugged by tar. It is also possible to use tar or another adhesive to connect the two gas-channel parts.

Figure 10:
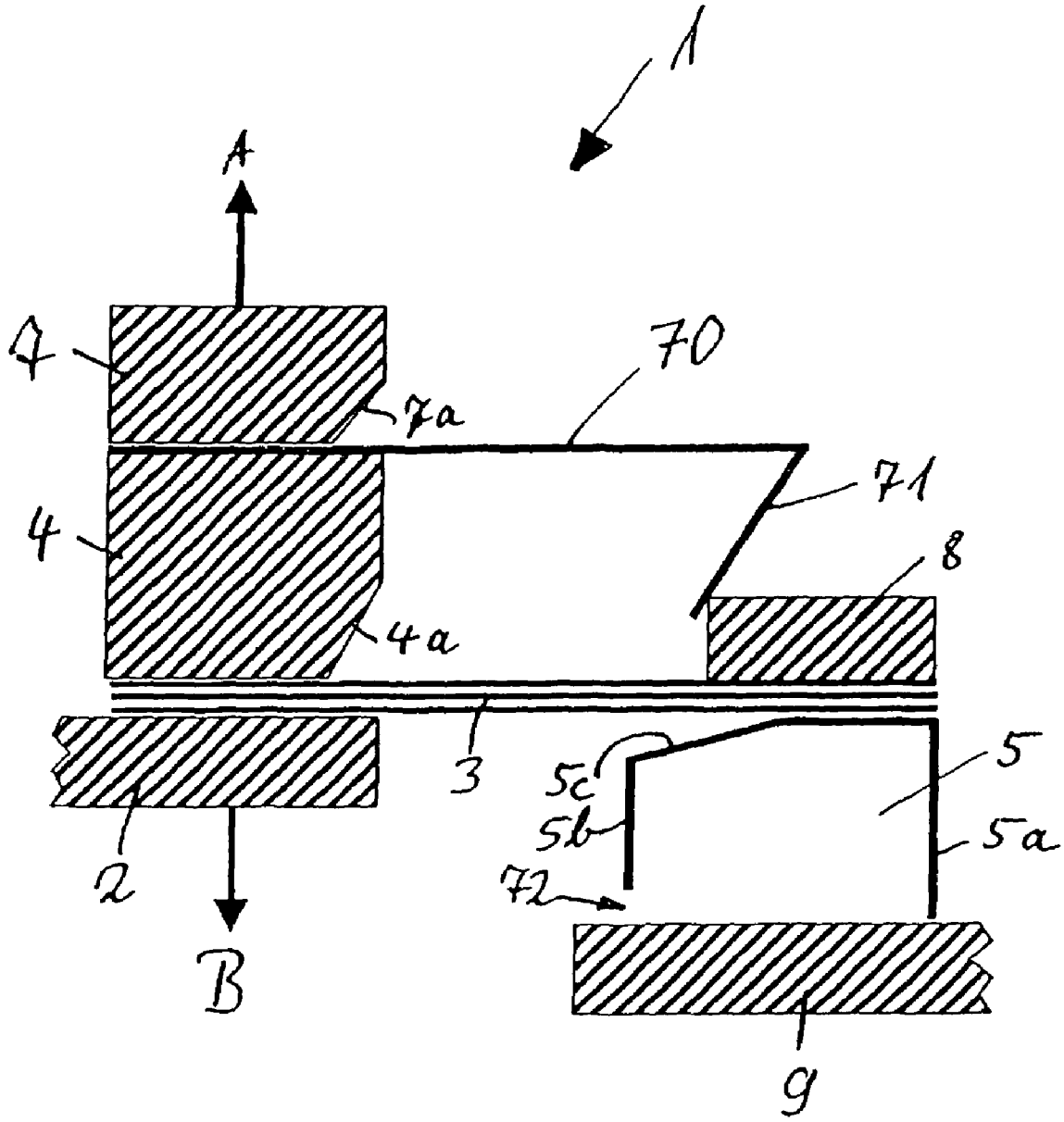
FIG. 10 is an embodiment with a considerable range of biased movement.

FIG. 10 shows how a leaf spring 70 bears with a slide face 71 on the bar 8 and thus against the membrane 3 and the gas channel 5. When the coke-oven door 1 and/or the chamber frame 9 deform as shown by arrows A and B the leaf spring 70 shifts with its slide face 7*a* along an edge of the bar 8. The extent of spring travel is determined by the stroke of the leaf spring 70, the stroke defined by angular deformation of the slide face 7*a* and the leaf spring 70, and the sliding of the bar 8 along the slide face. The sum of these three factors produces a considerable amount of possible movement. The inner door-seal edge 5*b* of the gas channel forms a gap 72. On movement of the coke-oven door 1 in the direction of the arrow B the outer door-seal edge 5*a* of the gas channel engages the chamber frame 9. Further movement in this direction first presses the outer door-seal edge 5*a* of the gas channel on the chamber frame 9. On further movement the inner edge 5*b* of the gas channel seats and the gap 72 is closed. In this manner the already large spring travel of this system is further increased. On opposite movement of the coke-oven door in the direction of the arrow A the inner door-seal edge 5*b* of the gas channel first lifts off the chamber frame 9 while the outer door-seal edge 5*a* of the gas channel 5 still seals.

The invention claimed is:

1. In combination with a coke-oven door having an annular periphery normally juxtaposed with an annular door frame, a seal assembly comprising:

at least two flexible, relatively displaceable, metallic, and annular membranes each having an annular inner periphery and an annular outer periphery;

a U-section channel fixed to the outer periphery of only one of the membranes, open toward the door, and having annular inner and outer edges, the other of the membranes bearing on the one membrane and therethrough on the channel;

mounting means for securing the inner peripheries of the membranes to the periphery of the door; and spring means for urging the edges of the channel with a spring force against the door frame.

2. The door seal assembly defined in claim 1 wherein there at least four membranes.

3. The door seal assembly defined in claim 1 wherein the membranes are of different thicknesses.

4. The door seal assembly defined in claim 1 wherein at least one of the membranes is elastically deformable and forms part of the spring means.

5. The door seal assembly defined in claim 1 wherein the membranes are of different materials.

6. The door seal assembly defined in claim 1 wherein the spring means includes a plurality of leaf springs each having an inner end attached to the door and an outer end bearing on the membranes and channel.

7. The door seal assembly defined in claim 6 wherein the leaf springs are of different lengths.

8. The door seal assembly defined in claim 6 wherein the leaf springs are spaced apart.

9. The door seal assembly defined in claim 6 wherein the outer ends of the leaf springs are bent toward the door.

10. The door seal assembly defined in claim 6 wherein the spring means further includes a wedge engageable between the leaf springs.

11. The door seal assembly defined in claim 1 wherein the spring means includes an array of push rods bearing against the membranes and channel, and respective springs engaged between the push rods and the door.

12. The door seal assembly defined in claim 11 wherein the springs are each constitute by a stack of spring washers.

13. The door seal assembly defined in claim 11 wherein the spring means further includes a pressure-equalization bar extending generally parallel to the door between the array or rods on one side and the channel and membranes on the other side.

14. The door seal assembly defined in claim 11 wherein the spring means includes abutment screws fixed on the membranes and engageable with the door.

15. In combination with a coke-oven door having an annular periphery normally juxtaposed with an annular door frame, a seal assembly comprising:

an annular membrane formed of at least two flexible and relatively displaceable sheets each having an annular inner periphery and an annular outer periphery;

a U-section channel fixed to the outer peripheries of the sheets, open toward the door, and having annular inner and outer edges;

mounting means for securing the inner periphery to the periphery of the door;

spring means for urging the edges of the channel with a spring force against the door frame; and webs extending between the membranes and forming passages, whereby a heat-exchange liquid can be flowed through the passages.

16. The door seal assembly defined in claim 1 wherein the membranes are leaf springs.

17. The door seal assembly defined in claim 1 wherein the membranes are planar and generally parallel.

18. The door seal assembly defined in claim 17 wherein the membranes flatly engage one another.

* * * * *